United States Patent [19]

Götting et al.

[11] Patent Number: 4,926,666

[45] Date of Patent: May 22, 1990

[54] ASSEMBLY FOR ADJUSTING THE ROLLS OF PUNCHING AND LIKE MACHINES

[75] Inventors: Georg Götting, Lörrach; Harro Lämmle, Schopfheim, both of Fed. Rep. of Germany

[73] Assignee: Grapha-Holding AG, Hergiswil, Switzerland

[21] Appl. No.: 205,081

[22] Filed: Jun. 9, 1988

[30] Foreign Application Priority Data

Jun. 19, 1987 [CH] Switzerland ..... 2326/87

[51] Int. Cl.[5] ..... B21B 31/18

[52] U.S. Cl. ..... 72/247; 72/248

[58] Field of Search ..... 29/122; 72/247, 248, 72/197; 74/397; 100/168, 176; 384/256; 101/219, 225, 227

[56] References Cited

U.S. PATENT DOCUMENTS 2,106,866 2/1938 Best ..... 72/102
3,162,070 12/1964 Morgan et al. ..... 72/198
3,197,991 8/1965 Radamaker ..... 72/247
3,599,463 8/1971 Sennstrom ..... 72/237

*Primary Examiner*—Lowell A. Larson
*Assistant Examiner*—Thomas C. Schoeffler
*Attorney, Agent, or Firm*—Peter K. Kontler

[57] ABSTRACT

Two parallel cylindrical rolls in a punching, stamping, printing, smoothing or like machine for running webs of paper or the like carry pairs of hardened bearing rings which have complementary conical surfaces with the conical surfaces of rings for one of the rolls tapering in one direction and with the conical surfaces of rings for the other roll tapering in the opposite direction but at the same angle. This ensures that the rings for one of the rolls are in linear contact with the rings for the other roll. One of the rolls is movable radially of the other roll to change the pressure upon the web which is running through the nip of the rolls, and one of the rolls is movable axially of the other roll to compensate for wear upon the conical surfaces of the bearing rings. All such adjustments can be carried out while the machine employing the rolls is in use.

13 Claims, 1 Drawing Sheet

ASSEMBLY FOR ADJUSTING THE ROLLS OF PUNCHING AND LIKE MACHINES

BACKGROUND OF THE INVENTION

The invention relates to improvements in machines wherein single-layer or multiple-layer webs or sheets of textile material, paper, metallic foil, plastic foil or the like are treated during travel through the nips of rolls. Typical examples of such machines are printing, punching or stamping machines wherein webs of paper or other material are caused to advance through the nip or nips of one or more pairs of rolls which rotate in opposite directions.

The pressure which the rolls of a stamping, printing, punching or like machine apply to a running web of paper or the like must be regulated with a high degree of precision. The arrangement is normally such that the pressure should remain constant at all times, even in response to changes of load. Furthermore, it is desirable and advantageous to mount the rolls in such a way that they can be readily moved apart in order to introduce the leader of a web into the nip of such rolls, and that the rolls can be readily and rapidly moved to operative positions in which they bear upon the running web with a prescribed optimum force.

As a rule, the rolls in a stamping, punching or like machine carry pairs of so-called Schmitz rings which are bearing rings made of hardened metallic material and provided with cylindrical peripheral surfaces. The peripheral surfaces of bearing rings on one of the rolls abut the peripheral surfaces of bearing rings on the other roll to thus ensure that the distance between the axes of the rolls remains at a selected value. A drawback of such bearing rings is that the distance between the axes of the rolls cannot be reduced, i.e., the radial distance of the axes of the rolls from one another cannot be reduced when the cylindrical peripheral surfaces of bearing rings for one of the rolls abut the cylindrical peripheral surfaces of bearing rings for the other roll. On the other hand, radial adjustability of the rolls relative to each other is desirable, advantageous and often indispensable in order to compensate for changes of dimensions as a result of heating or cooling of the rolls and their bearing rings, to compensate for wear upon the bearing rings and/or upon the rolls, and/or to account for changes of the thickness of running webs or sheets.

Conformance of the width of the nip of two rolls to the thickness of a conveyed web, such as a paper web, is particularly important in connection with rotative stamping or punching of adhesive-coated labels. Thus, it is necessary to invariably cut through the layer which is to be converted into a series of labels but to leave the substrate (to which the labels adhere) intact. Such machines can operate properly, and their output can be satisfactory, only if they are provided with means for permitting repeated adjustment of the width of the nip of the rolls while the machines are in actual use. Even minor manufacturing tolerances and/or minor wear upon the rolls will necessitate highly accurate adjustments in order to ensure that each label will be fully separated from the remnent of the respective layer of the laminated structure which is caused to pass through the nip while the substrate remains intact.

German Offenlegungsschrift No. 31 31 167 discloses a Schmitz ring which is adjustable, i.e., which is designed with a view to change its diameter. This is achieved by furnishing the Schmitz ring with replaceable bands or hoops which are made of sheet steel and are separably connectable to a rim of the Schmitz ring. Each hoop has a different thickness. A drawback of such proposal is that the diameter of the Schmitz ring can be changed only while the machine in which the ring is used is at a standstill. Moreover, it is necessary to move the roll which is provided with such Schmitz rings away from the neighboring roll or rolls so as to provide ample room for removal of previously used hoops and for the application of freshly selected hoops. Each exchange of hoops takes up a considerable amount of time. Still further, each Schmitz ring must be furnished with a large number of spare hoops, especially if it is desired to bring about numerous minimal changes of the outer diameter of the ring.

German Offenlegungsschrift No. 22 05 527 proposes to replace Schmitz rings with races and to employ a further (rolling) ring which operates between a pair of races. Two races must be freely rotatable about the axis of one of the rolls. A drawback of this proposal is the high cost and that the operation of the machine wherein the rolls are held at a desired axial distance from each other is satisfactory only as long as the bearings do not run out of true.

OBJECTS AND SUMMARY OF THE INVENTION

An object of the invention is to provide a novel and improved assembly of cooperating rolls or cylinders wherein the width of the nip of such rolls or cylinders can be maintained at a selected value and/or altered with a high degree of precision in a novel and improved way.

Another object of the invention is to provide an assembly which employs Schmitz rings or bearing rings of a design such that the bearing rings exhibit all advantages of conventional bearing rings and, in addition, permit rapid, accurate and convenient adjustment of the width of the nip while the machine employing the improved assembly is in actual use.

A further object of the invention is to provide the assembly with a novel and improved mechanism which can compensate for wear upon the bearing rings and/or upon the rolls while the machine employing the assembly is in use.

An additional object of the invention is to provide the assembly with novel and improved means for varying the pressure upon the running web or sheet while the machine employing the assembly is in actual use.

Still another object of the invention is to provide a punching, stamping, printing, smoothing or other machine which embodies the above outlined assembly.

A further object of the invention is to provide novel and improved Schmitz rings.

An additional object of the invention is to provide a novel and improved method of regulating the radial distance between the rolls in a punching or like machine and a novel and improved method of compensating for wear upon the rolls and/or Schmitz rings in such machine.

The invention is embodied in an arrangement or assembly for treating a running web or sheet of paper, metallic or plastic foil, textile material or the like, particularly in a punching, printing, stamping, embossing or like machine. The improved assembly comprises a first roll (e.g., an elongated cylinder), a second roll which can constitute a second elongated cylinder defining with the first roll a nip for the running web or sheet, and means for selecting the width of the nip including a plurality of first bearing rings (of the type called Schmitz rings or cylinder bearers) which are coaxial with the first roll and have conical peripheral surfaces tapering toward the axis of the first roll in a first direction, and a plurality of second bearing rings, one for each of the first rings, with conical peripheral surfaces which are coaxial with the second roll and taper toward the axis of the second roll in a second direction counter to the first direction. The peripheral surface of each second ring abuts the peripheral surface of the respective first ring, and the width selecting means further comprises means for moving at least the first rings (preferably with the first roll) axially relative to the second rings to thereby increase the distance between the rolls (and hence the width of the nip) or to enable the rolls to move nearer to each other (i.e., to reduce the width of the nip). The axes of the rolls are preferably parallel to each other. The peripheral surfaces of the first rings make with the axis of the first roll a first acute angle, and the peripheral surfaces of the second rings make with the axis of the second roll a second acute angle which is preferably identical with the first angle. The bearing rings can be made of surface hardened steel or any other suitable material.

The assembly further comprise a support (such support can comprise two spaced-apart frame members or cheeks and the rolls can have end portions (e.g., in the form of stubs) which are journalled in the frame members). The moving means can comprise mating male and female threaded members one of which is provided on the first roll and the other of which is provided on the support. One of the threaded members can be rotated relative to the other threaded member (e.g., by hand through the medium of a knurled knob or by a suitable tool) to thereby move the first roll and the first rings axially relative to the second rings (and relative to the second roll if the second roll cannot move axially relative to the second rings). The threaded members are or can be coaxial with the first roll and hence with the first rings. Each of these rings can constitute a conical frustum.

The assembly can further comprise means for shifting one of the rolls (preferably with the respective rings) radially of the other roll. This is desirable in order to alter the pressure which the peripheral surfaces of the rolls exert upon a web or sheet which is caused to run through the nip of the first and second rolls. The shifting means can comprise sleeves rotatable in cylindrical internal surfaces of the aforementioned frame members and having eccentric internal surfaces for portions of the one roll. The shifting means further comprises means for rotating the sleeves relative to the internal surfaces of the respective frame members, and such rotating means can include first gears which are rigid with the sleeves, second gears which mate with the first gears, and a shaft or other suitable means for rotating the second gears to thereby change the orientation of the first gears and of the sleeves relative to the internal surfaces of the frame members with attendant movement of the one roll radially toward or away from the other roll. Each of the first and second gears can constitute a gear segment.

The assembly can further comprise means for rotating or driving the rolls, preferably at the same peripheral speed. Such rotating or driving means can include a first spur gear which is rigid with the first roll and a second spur gear which is rigid with the second roll and mates with the first gear in each axial position of the first bearing rings relative to the second bearing rings, i.e., each of the gears has a thickness (or at least one of the gears) has a thickness such that it remains in proper mesh with the other gear even if one of the gears is compelled to share the axial movements of the first bearing rings relative to the second bearing rings.

It normally suffices to provide two bearing rings for each roll and to place each roll between the respective bearing rings.

The novel features which are considered as characteristic of the invention are set forth in particular in the appended claims. The improved assembly itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
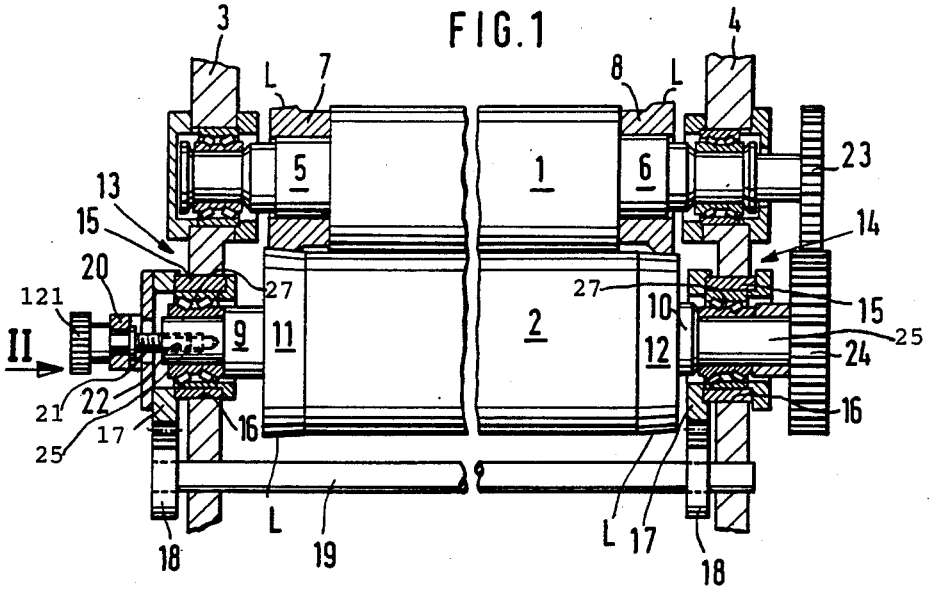
FIG. 1 is a fragmentary partly elevational and partly vertical sectional view of an assembly which embodies one form of the invention.

The assembly which is shown in FIG. 1 can form part of a pressing, printing, stamping, embossing, punching, glazing or like machine and includes two parallel cylindrical rolls 1 and 2 defining a nip 26 (FIG. 2) for a running web or sheet (not shown) of paper, metallic or plastic foil, textile material or any other strip- or panel-like material which is treated during travel through the nip 26. The support for the end portions of the rolls 1, 2 includes two spaced-apart frame members or cheeks 3 and 4 which can constitute component parts of the frame of a punching, stamping or like machine. The cylindrical sections 5 and 6 of the stubs of the roll 1 are respectively surrounded by bearing rings (Schmitz rings) 7 and 8 whose frustoconical peripheral surfaces L slope in the same direction with reference to the axis of the roll 1, namely to the left as seen in FIG. 1. The acute angle which the peripheral surface L of the bearing ring 7 makes with the axis of the roll 1 is the same as that between such axis and the peripheral surface L of the bearing ring 8.

The portions 9, 10 of the stubs at the ends of the larger-diameter roll 2 carry bearing rings 11 and 12 whose conical peripheral surfaces L respectively abut the peripheral surfaces L of the bearing rings 7 and 8. The inclination of the peripheral surfaces L of the bearing rings 11, 12 with reference to the axis of the roll 2 is the same as that of the peripheral surfaces of the bearing rings 7, 8 relative to the axis of the roll 1 except that the peripheral surfaces L of the bearing rings 11 and 12 slope in the opposite direction (to the right as seen in FIG. 1). Thus, it can be said that the peripheral surfaces L of the bearing rings 7, 11 are in linear contact with one another and that the peripheral surfaces L of the bearing rings 8, 12 are also in linear contact with each other.

The roll 2 and the corresponding bearing rings 11, 12 have limited freedom of axially movability relative to the roll 1 and the bearing rings 7, 8. To this end, the end portions of the roll 2 are mounted in bearings 13 and 14 which are respectively provided in the frame members 3 and 4 of the support for the rolls 1 and 2. The bearings 13, 14 comprise sleeves 15 which are rotatable in cylindrical internal surfaces 16 of the respective frame members 3, 4 and each sleeve 15 has an eccentric cylindrical internal surface for a thrust bearing 27 surrounding the respective end portion 25 of the corresponding stub of the roll 2. The sleeves 15 can be said to constitute eccentrics which can be turned about their respective axes to thereby move the roll 2 nearer to or further away from the roll 1. In addition to the eccentric sleeves 15, the means for shifting the roll 2 and its bearing rings 11, 12 radially of the roll 1 comprises gears 17 which are rigid with the sleeves 15, gears 18 which mate with the gears 17, and a shaft 19 which is journalled in the frame members 3, 4 and serves to rotate the gears 18. The illustrated gears 17 and 18 are merely segments of spur gears because a relatively small angular displacement of the shaft 19 and of gear segments 18 thereon suffices to change the angular positions of the sleeves 15 to an extent which is necessary to select the distance between the axes of the rolls 1 and 2. Such shiftability of the roll 2 radially of the roll 1 is desirable and advantageous because the operators can change the pressure of the peripheral surfaces of the rolls 1 and 2 upon a web which is caused to run through the nip 26. The shaft 19 can be rotated manually, e.g., by employing a wrench or a handwheel, or by a suitable motor, not shown. The adjustment can be automatic and can take place in response to monitoring of the quality of those increments of the web which issue from the nip 26. Alternatively, the radial position of the roll 2 relative to the roll 1 can be altered in response to signals from one or more strain gauges or other suitable stress monitoring devices.

The frame member 3 carries a yoke 20 which extends diametrically of the adjacent stub of the roll 2 and carries a male threaded member 21 which mates with a female threaded member 22 forming an integral part of the roll 2 or of its left-hand stub. The head 121 of the male threaded member 21 serves as a means for rotating the member 21 in order to move the roll 2 and the bearing rings 11, 12 axially so as to compensate for wear upon the peripheral surfaces L of the rings 7, 8 and 11, 12. Thus, the male and female threaded members 21, 22 constitute or form part of the means for moving the bearing rings 11, 12 in the direction of the axis of the roll 2 (which shares such movements of the rings 11, 12 because it is disposed between them and its stubs carry these bearing rings). The common axis of the threaded members 21, 22 coincides with the common axis of the roll 2 and bearing rings 11, 12. The male threaded member 21 can constitute the shank of a screw whose head 121 is preferably knurled or facetted so that it can be readily rotated by a relatively simple tool or even by hand. Suitable graduations can be provided next to the head 121 and next to one or both gear segments 17 and/or 18 to indicate the extent of axial displacement of the roll 2 relative to the roll 1 and the radial position of the roll 2 with reference to the roll 1.

Figure 2:
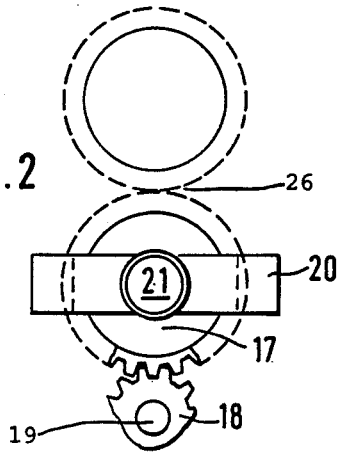
FIG. 2 is an end elevational view of the shifting and moving means as seen in the direction of arrow II in FIG. 1, with the rolls indicated by broken-line circles.

If the operators wish to move the roll 2 and the bearing rings 11, 12 axially with reference to the roll 1 and bearing rings 7, 8, the shifting means 15–19 is preferably actuated first to move the roll 2 and the bearing rings 11, 12 radially of and away from the roll 1 and bearing rings 7, 8 to thus permit an axial adjustment of the roll 2 in response to the exertion of a smaller force The shifting means 15–19 is thereupon actuated to select the magnitude of the force with which the rings 11, 12 bear upon the rings 7, 8 and the force with which the peripheral surfaces of the folls 1 and 2 engage the web which is running through the nip 26 when the assembly of FIGS. 1 and 2 is in actual use. The roll 2 can be shifted radially of and away from the roll 1 simultaneously with manipulation of the head 121 for the purpose of moving the roll 2 axially.

The assembly further comprises means for rotating the rolls 1 and 2, preferably at the same peripheral speed. Such rotating means comprises a first spur gear 23 which is affixed to the respective stub of the roll 1, and a second spur gear 24 which mates with the spur gear 23 and is affixed to the respective stub of the roll 2. The thickness (axial length) of the gear 24 is such that the gears 23, 24 remain in mesh in each axial position of the roll 2 relative to the roll 1. The gear 23 or 24 can receive torque from a prime mover, not shown, through the medium of a further gear.

As mentioned above, the rolls 1 and 2 can be used with advantage in stamping, printing, punching or like machines. However, the improved assembly can also be put to use in many other types of machines or apparatus, e.g., to smooth, emboss, calender and/or otherwise treat running webs of paper, foil, fabric or the like.

An important advantage of the improved assembly is that the bearing rings 7, 8 and 11, 12 can perform all functions of conventional Schmitz rings (with cylindrical peripheral surfaces) and, at the same time, enable the roll 2 to move axially and/or radially relative to the roll 1 in order to adjust the pressure upon the running web and/or to compensate for wear upon the peripheral surfaces of the bearing rings. All this can be accomplished by the simple expedient of employing bearing rings with conical peripheral surfaces and by providing simple, compact and inexpensive means for moving the roll 2 axially and for moving the roll 2 radially of the roll 1. It goes without saying that the roll 2 can be mounted in the support including the frame members 3, 4 for rotation about a fixed axis and that the roll 1 is then mounted for movement in the direction of its axis as well as or radially of the roll 2. It is even possible to mount each of the rolls 1, 2 for axial movement as well as for movement radially toward or away from the other roll.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an assembly for treating a running sheet or web, particularly in a punching or a like machine, a combination comprising a first roll; a second roll defining with the first roll a nip for the running web or sheet; and means for selecting the width of the nip, including a plurality of first bearing rings coaxial with said first roll and having conical peripheral surfaces tapering toward the axis of the first roll in a first direction, a plurality of second bearing rings, one for each of said first rings, said second rings being coaxial with said second roll and having conical peripheral surfaces tapering toward the axis of the second roll in a second direction counter to said first direction, the peripheral surfaces of said first rings abutting the peripheral surfaces of the respective second rings, and means for moving at least the first rings and the first roll axially relative to the second rings.

2. The combination of claim 1, wherein said rolls are cylinders and have parallel axes.

3. The combination of claim 1, wherein the peripheral surfaces of said first rings make with the axis of the first roll a first acute angle and the peripheral surfaces of said second rings make with the axis of the second roll a second angle which is identical with said first angle.

4. The combination of claim 1, further comprising means for shifting one of said rolls radially of the other of said rolls.

5. The combination of claim 4, further comprising a support, said rolls being rotatably journalled in said support and said shifting means comprising cylindrical internal surfaces provided in said support and eccentrics provided on said one roll and disposed within said internal surfaces.

6. The combination of claim 5, wherein said support includes two frame members and said internal surfaces are provided in said frame members.

7. The combination of claim 5, wherein said shifting means further comprises means for rotating the eccentrics relative to the respective internal surfaces, including first gears rigid with said eccentrics, second gears mating with said first gears, and means for rotating said second gears.

8. The combination of claim 1, further comprising a support, said rolls having end portions journalled in said support and said moving means comprising mating male and female threaded members, one of said members being provided on said first roll and the other of said members being provided on said support, said moving means further comprising means for rotating one of said members relative to the other of said members to thereby move said first roll and the first rings axially relative to the second rings.

9. The combination of claim 8, wherein said threaded members are coaxial with said first roll.

10. The combination of claim 1, wherein each of said rings is a conical frustum.

11. The combination of claim 1, further comprising means for rotating said rolls at identical peripheral speeds.

12. The combination of claim 1, further comprising means for rotating said rolls, including a first gear rigid with said first roll and a second gear rigid with said second roll and mating with said first gear in each axial position of said first bearing rings relative to said second bearing rings.

13. The combination of claim 1, wherein said first bearing rings include a first pair of spaced-apart bearing rings and said first roll is disposed between the bearing rings of said first pair, said second bearing rings including a second pair of spaced-apart bearing rings and said second roll being disposed between the rings of said second pair.

* * * * *